US009119238B2

(12) United States Patent
Hu et al.

(10) Patent No.: US 9,119,238 B2
(45) Date of Patent: Aug. 25, 2015

(54) METHOD AND APPARATUS FOR LED DRIVING AND DIMMING, AND ILLUMINATION SYSTEM

(75) Inventors: Yang Hu, Shanghai (CN); LiBo Wu, Shaoxing (CN)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/820,160

(22) PCT Filed: Aug. 26, 2011

(86) PCT No.: PCT/EP2011/064744

§ 371 (c)(1), (2), (4) Date: Mar. 1, 2013

(87) PCT Pub. No.: WO2012/028554

PCT Pub. Date: Mar. 8, 2012

(65) Prior Publication Data

US 2013/0154500 A1 Jun. 20, 2013

(30) Foreign Application Priority Data

Sep. 3, 2010 (CN) ..... 2010 1 0273623

(51) Int. Cl.

*H05B 41/16* (2006.01)
*H05B 37/02* (2006.01)
*H05B 33/08* (2006.01)

(52) U.S. Cl.

CPC ..... *H05B 37/02* (2013.01); *H05B 33/0818* (2013.01); *H05B 33/0851* (2013.01)

(58) Field of Classification Search

CPC .... H05B 37/02; H05B 33/08; H05B 33/0803; H05B 33/0806; H05B 33/0833; H05B 33/0836; H05B 33/0839

USPC ..... 315/209 R, 219, 246, 247, 283, 287, 315/291, 308

See application file for complete search history.

(56) References Cited

U.S. PATENT DOCUMENTS 7,659,673 B2 * 2/2010 Lys ..... 315/247
7,960,921 B2 * 6/2011 Grajcar ..... 315/291

(Continued)

FOREIGN PATENT DOCUMENTS

CN 1469694 A 1/2004
CN 1802056 A 7/2006

(Continued)

OTHER PUBLICATIONS

Aleksandar M. Stanković et al. Analysis and Synthesis of Randomized Modulation Schemes for Power Converters IEEE Transaction on Power Electronics; Nov. 1995; pp. 680-693; vol. 10, Issue No. 6.

(Continued)

*Primary Examiner* — Thuy Vinh Tran

(57) ABSTRACT

A method for driving an LED connected to a power switch is provided. The method includes: determining a duty cycle of a pulse sequence for controlling the power switch according to a present current and a predetermined operating current of the LED; generating the pulse sequence according to the duty cycle and according to at least one of a randomized period sequence and a randomized pulse position sequence; and controlling switching operation of the power switch by the pulse sequence, so as to drive the LED. An apparatus for driving a light emitting diode, an apparatus for dimming a light emitting diode and illumination systems are also provided.

16 Claims, 13 Drawing Sheets

(56) References Cited

U.S. PATENT DOCUMENTS

| | | | | |
|---|---|---|---|---|
| 8,344,657 | B2 * | 1/2013 | Zhan et al. | 315/302 |
| 8,421,369 | B2 | 4/2013 | Cheon et al. | |
| 8,456,103 | B2 * | 6/2013 | Grajcar | 315/291 |
| 8,487,546 | B2 * | 7/2013 | Melanson | 315/291 |
| 2003/0227265 | A1 | 12/2003 | Biebl | |
| 2007/0108916 | A1 | 5/2007 | Wang et al. | |
| 2008/0224636 | A1 | 9/2008 | Melanson | |
| 2010/0148678 | A1 | 6/2010 | Simmers | |
| 2010/0277088 | A1 * | 11/2010 | Bodano | 315/283 |

FOREIGN PATENT DOCUMENTS

| | | | |
|---|---|---|---|
| CN | 101730343 | A | 6/2010 |
| WO | 2009013698 | A1 | 1/2009 |

OTHER PUBLICATIONS

Chinese office action issued on Sep. 3, 2014 for the corresponding Chinese Application No. 201010273623.8 including the English translation, 16 pages.

* cited by examiner

METHOD AND APPARATUS FOR LED DRIVING AND DIMMING, AND ILLUMINATION SYSTEM

RELATED APPLICATIONS

The present application is a national stage entry according to 35 U.S.C. §371 of PCT application No.: PCT/EP2011/064744 filed on Aug. 26, 2011, which claims priority from Chinese application No.: 201010273623.8 filed on Sep. 3, 2010.

FIELD OF INVENTION

The present invention relates to an illumination field, in particular to method and apparatus for driving an LED, method and apparatus for dimming an LED, an illumination system including an apparatus for driving an LED, and an illumination system including an apparatus for dimming an LED.

BACKGROUND OF THE INVENTION

With the improving lumen efficiency of Light-Emitting Diode (referred to as LED for short) chip and package for illumination, Solid-State Lighting (referred to as SSL for short) including LED for general lighting is becoming an important application. Since standard 1 W LED is usually working with around 3.3V and 350 mA, for most applications, electronic drivers are needed to regulate the LED current. High frequency power electronic converters such as Buck converter, Fly-back converter or other converter with stepping-down topologies are often used in those electronic drivers.

For power electronic converter, Pulse Width Modulation (referred to as PWM for short) is the technique which can adjust the width of the conducting pulse of the power switch (for example, power semiconductor device), so as to control the amount of power sent to the load. PWM control could be realized with designated controller integrated circuit (referred to as IC for short) chips or with some micro-controllers. In most electronics converters with PWM control, the switching frequency is fixed. One problem with the fixed switching frequency is the high harmonics interference in power spectrum at multiples of the base frequency.

Electromagnetic interference (referred to as EMI for short), that is, the so-called radio frequency interference (referred to as RFI for short) is a disturbance that affects other electrical circuit due to either electromagnetic conduction or electromagnetic radiation emitted from an external source. There arc technical requirements for electronics products including all commercial/residential lighting products including EMI. Different countries or regions have their regulations for EMI, which means, the electronics products should generate less high frequency harmonics than required in the certain frequency range. To limit the EMI to the environment or to the AC line, input filter circuit is required to reduce high frequency harmonics in some applications, and this will increase cost and size of the system.

PWM control could be used in SSL for LED current regulating and/or for dimming control. Specifically, there will be two orders of PWM control. The first order of PWM control is by controlling the power semiconductor device switching to get constant LED driving current, wherein the switching frequency could be from 40 kHz to more than 1 MHz. The second order of PWM control is for dimming by switching operation the whole converter and LEDs, wherein the frequency is typically from 150 Hz to around 400 Hz. The frequency range of the second order of PWM control can help eliminate flickering effect of human eyes. Fixed frequency second order of PWM control will also have the high harmonics problem, and another problem is that, for some movie cameras with fixed recording frequency, fixed frequency regulation will cause flickering in the recorded video.

Electromagnetic conduction interference could be depressed by filter circuit (for example, inductors connected in series or capacitors in parallel). This is the most common solution for lighting sources with integrated electronic driver. However, input filter circuit will increase cost and size of the system. For some power electronic applications with PWM control, such as electrical machine drive or switch-mode power supply, Random PWM (referred to RPWM for short) has been used to distribute the EMI energy to wide frequency band, so as to reduce the harmonies amplitude and noise (Analysis and synthesis of randomized modulation schemes for power converters. Stankovic, A. M. Verghese, G. E.; Perreault, D. J.; Power Electronics, IEEE transactions on Volume 10, Issue 6, November 1995 Page(s):680-693). For LED lighting, since most state-of-arts designs do not have microcontroller to realize such complex control algorithm, drivers are still working at fixed switching frequency. With the increasing wattage level of the LED lighting systems and with integration of dimming function, noise and EMI will become more and more important for electronic design. However, there exist problems of larger circuit size, high EMI and LED flickering in the present technologies.

FIG. 1 is a circuit diagram of an example LED driving circuit according to an existing technology. As shown in FIG. 1, the LED driving circuit comprises capacitor C, free wheel diode FWD, inductor L, light emitting diode (or light emitting diode series) LED, and power switch PSW. The specific connection relations among those elements are shown in FIG. 1. The light emitting diode series LED is connected to the inductor L and the power switch PSW in series when the power switch PSW is turned on. The free wheel diode FWD will turn on to pass the inductor current when the power switch PSW is turned off. By regulating the duty cycle of the power switch PSW, the current of the light emitting diode series LED could be controlled. The switching frequency of the circuit could be from 40 kHz to more than 1 MHz. For the circuit with fixed switching frequency, FIG. 2 illustrates PWM driving signal and FIG. 3 illustrates the LED current waveform.

FIG. 4 is a diagram illustrating relations between output voltage and frequency under a control of the PWM driving signal shown in FIG. 2. As shown in FIG. 4, harmonies occurs at multiplies of the base frequency.

For PWM dimming, the duty cycle control is in low frequency of from 150 Hz to around 400 Hz. The power switch is still operating at the high frequency of kHz to MHz range, while the whole driving circuit is on and off at a low frequency. FIG. 5 shows simulated LED driving current waveform with PWM dimming according to the existing technology.

For the above technical problems, it is desired to provide a technique capable of reducing circuit size, decreasing EMI, and reducing flickering of the LED.

SUMMARY

A brief summary about the present invention is described hereinafter to provide basic understandings related to some aspects of the present invention. It should be understood that this summary is not an exhaustive summary related to the present invention. The summary is not intended to determine a key part or an important part of the present invention, nor does it intend to limit the scope of the present invention. The purpose of the summary is only to provide some concepts in simplified forms to prelude more detailed descriptions discussed later.

Various embodiments provide method and apparatus for driving an LED, and method and apparatus for dimming an LED, an illumination system including an apparatus for driving an LED, and an illumination system including an apparatus for dimming an LED.

According to one aspect of the present invention, a method for driving an LED is provided, wherein the LED is connected to a power switch. The method comprises: determining a duty cycle of a pulse sequence for controlling the power switch according to a present current and a predetermined operating current of the LED; generating pulse sequence according to the duty cycle and according to a randomized period sequence and/or randomized pulse position sequence; and controlling switching operation of the power switch by the pulse sequence, so as to drive the LED According to another aspect of the present invention, a method for dimming the LED is provided, wherein, the LED is connected to power switch. The method comprises: a determining duty cycle of a pulse sequence for controlling the power switch according to a present current and a desired brightness of the LED; generating pulse sequence according to a the duty cycle and according to the randomized period sequence and/or a randomized pulse position sequence; and controlling switching operation of the power switch by the pulse sequence, for dimming the LED to a desired brightness.

According to still another aspect of the present invention, an apparatus for driving the LED is provided. The apparatus comprises: a driving duty cycle determining module for determining a duty cycle according to a present current and a predetermined operating current of the LED; a driving pulse sequence generating module for generating pulse sequence according to the duty cycle and according to a randomized period sequence and/or a randomized pulse position sequence; and a driving power switch which is connected to the LED and is used for switching operation under a control of the pulse sequence, so as to drive the LED.

According to further another aspect of the present invention, an apparatus for dimming the LED is provided. The apparatus comprises: a dimming duty cycle determining module for determining a duty cycle according to a present current and a desired brightness of the LED; a dimming pulse sequence generating module for generating a pulse sequence according to the duty cycle and according to a randomized period sequence and/or a randomized pulse position sequence; and a dimming power switch which is connected to the LED and is used for switching operation under a control of the pulse sequence, for dimming the LED to a desired brightness.

According to further another aspect of the present invention, an illumination system is provided. The illumination system comprises LED and apparatus for driving the LED.

According to further another aspect of the present invention, an illumination system is provided. The illumination system comprises LED and apparatus for dimming the LED.

By applying the present invention, EMI may be decreased, and flicking of the LED may be reduced.

BRIEF DESCRIPTION OF THE DRAWINGS

Referring to the explanations of the present invention in conjunction with the Drawings, the above and other objects, features and advantages of the present invention will be understood more easily. Components in the Drawings are only intended to illustrate the principle of the present invention. In the Drawings, the same or similar technical features or components are represented by the same or similar reference signs.

DETAILED DESCRIPTION

Figure 1:
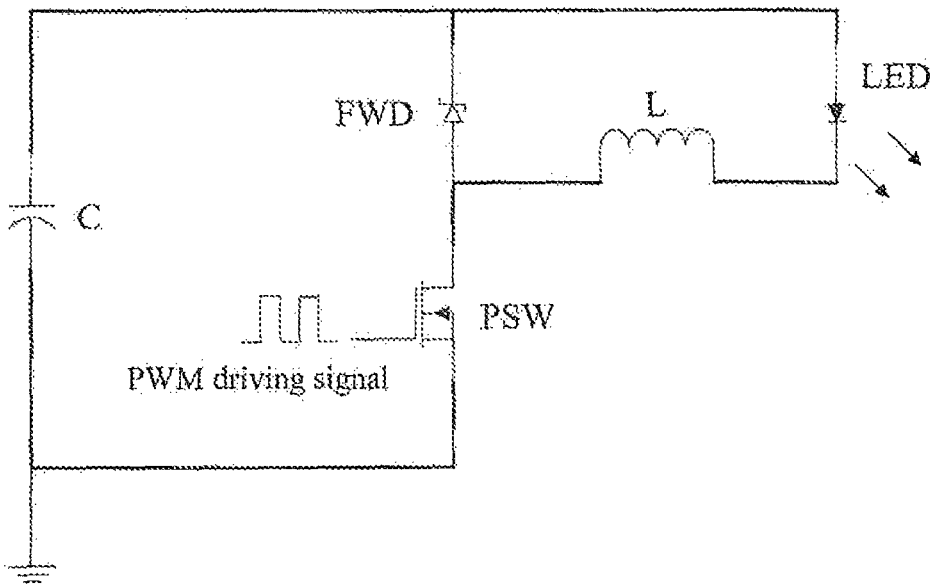
Fig. 1 Prior Art
FIG. 1 is a circuit diagram illustrating an example LED driving circuit according to the existing technology.
Figure 2:
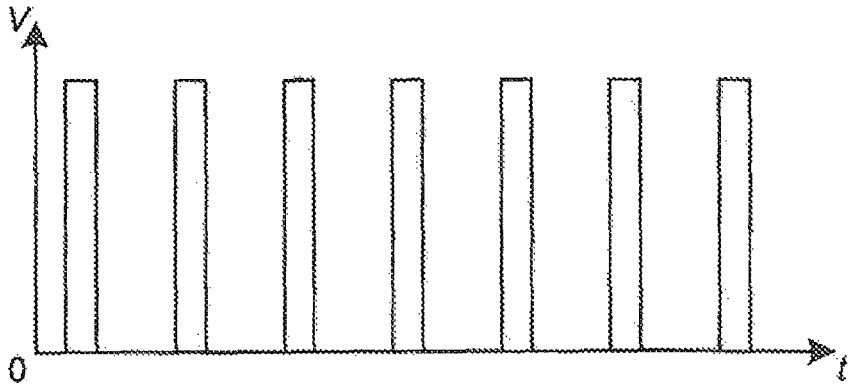
Fig. 2 Prior Art
FIG. 2 is a diagram illustrating the PWM driving signal according to the existing technology.
Figure 3:
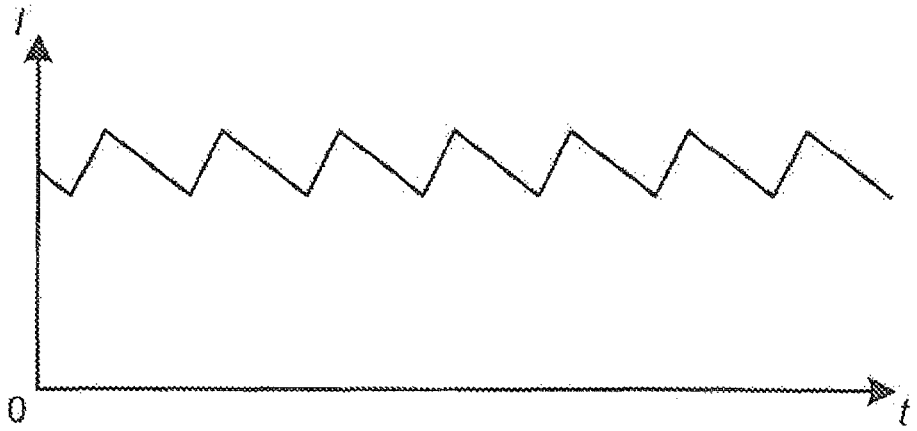
Fig. 3 Prior Art
FIG. 3 is a graph illustrating relations between current and time under a control of the PWM driving signal shown in FIG. 2.

The embodiments of the present invention are discussed hereinafter in conjunction with the Drawings. Elements and features described in one Drawing or one embodiment of the present invention may be combined with elements and features described in one or more other Drawings or embodiments. It should be noted that representation and description of components and processes unrelated to the present invention and well known to one of ordinary skill in the art are omitted in the Drawings and the Description for the purpose of being clear.

Figure 6:
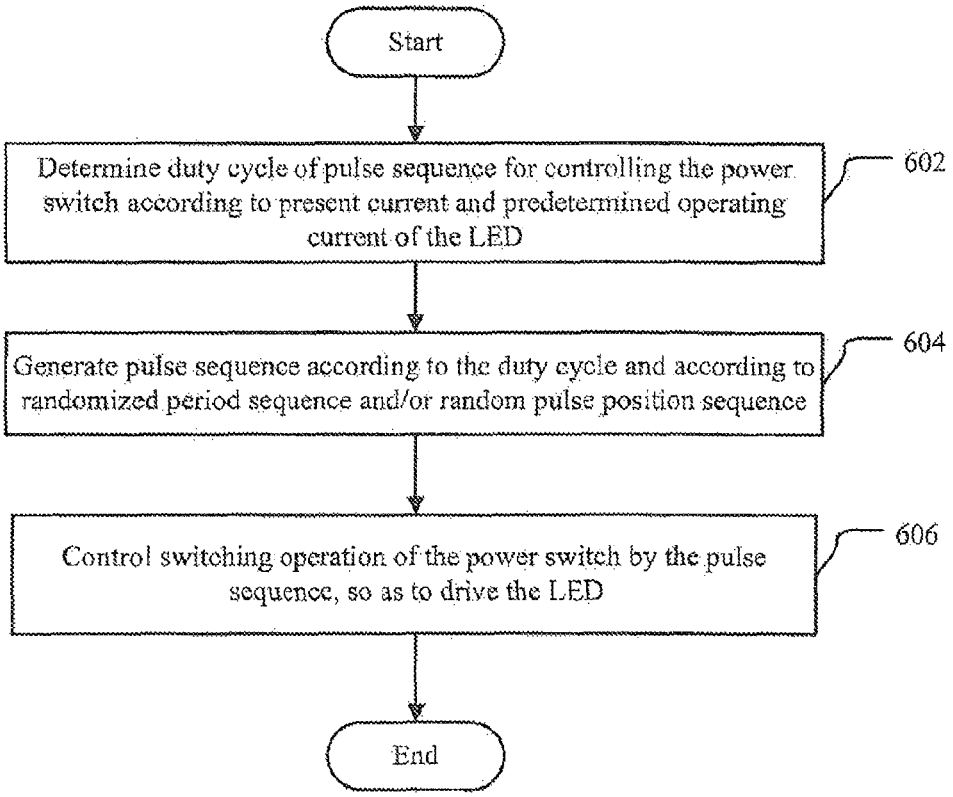
FIG. 6 is a flow chart of the method for driving the LED according to one embodiment of the present invention.

Referring to FIG. 6, the method for driving diode according to one embodiment of the present invention is described, wherein, the LED may be connected to power switch (for example, power semiconductor device and other appropriate power switches conventionally used in the art) through various manners.

As illustrated in FIG. 6, in step 602, the duty cycle of pulse sequence for controlling the power switch may be determined according to present current and predetermined operating current of the LED. In step 604, the pulse sequence is generated according to the duty cycle and according to the randomized period sequence and/or randomized pulse position sequence. In step 606, switching operation of the power switch is controlled by the pulse sequence for driving the LED.

Specifically, in the step 602, present current of the LED may be sampled, the sampled present current is compared with the predetermined operating current, and the duty cycle of the pulse sequence for controlling the power switch is calculated based on the comparison result. If the comparison result indicates that the sampled present current is higher than the predetermined operating current, the duty cycle may be reduced; if the comparison result indicates the sampled present current is lower than the predetermined operating current, the duty cycle may be increased.

In the step 604, a first random number sequence and a second random number sequence may be generated; a period sequence is generated according to the first random number sequence; the pulse position sequence is generated according to the second random number sequence; and pulse sequence having duty cycle and having period sequence and/or pulse position sequence is generated.

Alternatively, the randomized frequency sequence corresponding to the period sequence may be in a range of 40 kHz to 1 MHz.

Specifically, today most of the LED drivers are designed with PWM integrated circuit (IC) controller, so the IC controller may sample the LED driving current and compare the sampled signal with the reference in an integrated comparator to generate the PWM driving signal. If the current signal is lower than the reference, the IC controller will increase the duty cycle of the PWM output; if the current signal is higher than the reference, the IC controller will decrease the duty cycle of the PWM output. In this way, the circuit could achieve a constant LED driving current (that is, operating current). Wherein, the reference may be set based on the required driving current of the LED.

When the LED driving circuit having the IC controller gets to a steady state, the circuit is operating repeatedly. And the switching frequency of the power electronics device is fixed. To realize randomized PWM, the randomization algorithm may be used by a micro-controller or a micro-programmed control unit (referred to as MCU for short).

Figure 7:
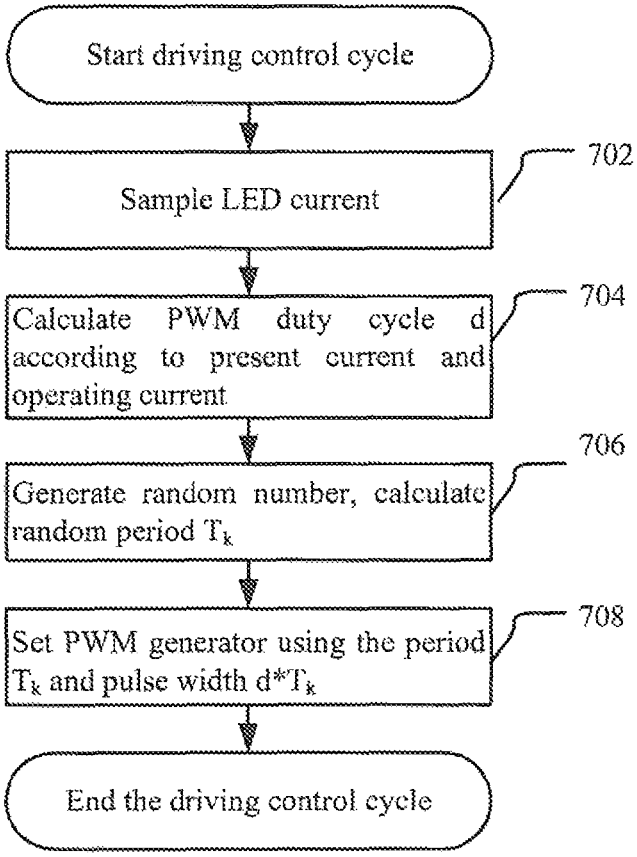
FIG. 7 is a flow chart of the method for driving the LED using randomized period modulation pulse signal according to one example of the present invention.

Referring to FIG. 7, the method for driving diode using randomized period modulation pulse signal according to one example is described.

As shown in FIG. 7, at first, start driving control cycle. Then, in step 702, sample the current of the LED to obtain a signal corresponding to the present current of the LED. In step 704, compare the sampled signal with the pre-stored reference, then calculate the duty cycle d according to the comparison result. Wherein, the reference is determined based on the operating current of the LED. In step 706, generate a random number sequence, and calculate randomized period sequence according to the random number sequence. In step 708, set PWM generator according to the calculated randomized period sequence and the pulse width to set the pulse modulation generator to generate pulse sequence, wherein, the pulse width is a product of the duty cycle and the period. Then, the LED is driven using the pulse sequence to make the current of the LED achieve the operating current. End the driving control cycle.

Figure 8:
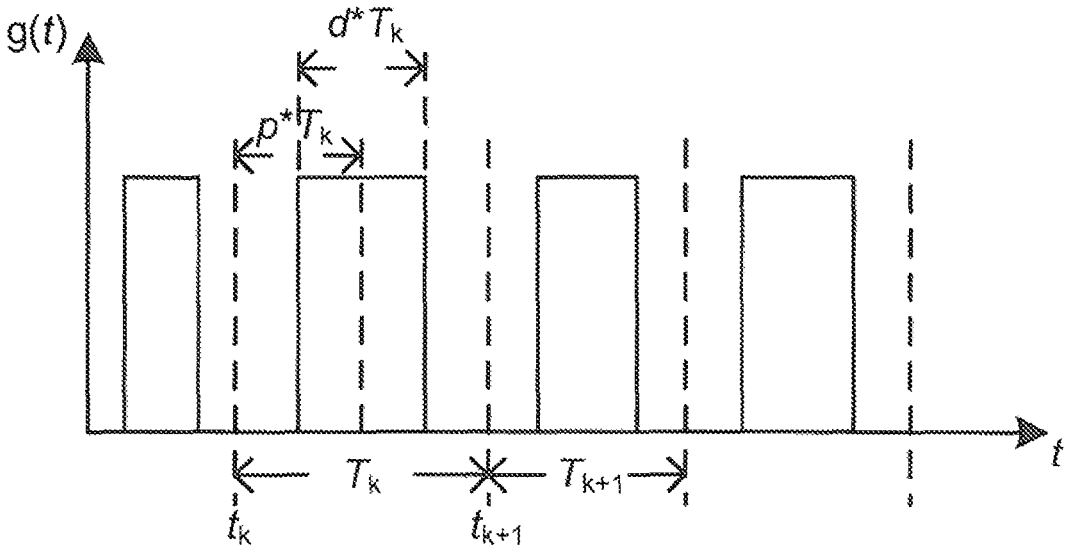
FIG. 8 is a graph illustrating relations between time and pulse signal with the randomized period modulation according to the example of FIG. 7.

FIG. 8 is a graph illustrating relations between time and pulse signal with the randomized period modulation according to the example of FIG. 7.

As shown in FIG. 8, for a switch cycle of the LED driving circuit, variables may include period $T_k$, position $p*T_k$ of the pulse centre, and the pulse width $d*T_k$. Because the duty cycle is determined by the driving current requirement and the duty cycle cannot be changed, randomization could be applied to period $T_k$ or position $p*T_k$ of the pulse centre to achieve the randomized PWM driving.

In FIG. 8, $T_k$ to $T_{k+1}$ are period time for each driving control cycle. Before the driving control cycle starts, the MCU controller will generate a randomized period time $T_{random}$ with special range, and then apply the randomized period time to a fixed period $T_0$, for example, $T_k=T_{random}+T_0$. By setting the duty cycle and pulse position, the PWM signal will be generated with the randomized period. Position of the pulse is normally in the centre of the control period, which is because it is easy to realize with the integrated PWM generator, a comparator with the reference and a saw-tooth counter. In FIG. 8, the duty cycle is 50%. Actually, the magnitude of the duty cycle is not limited to 50%, and the duty cycle may be other appropriate values in other specific application fields.

Figure 4:
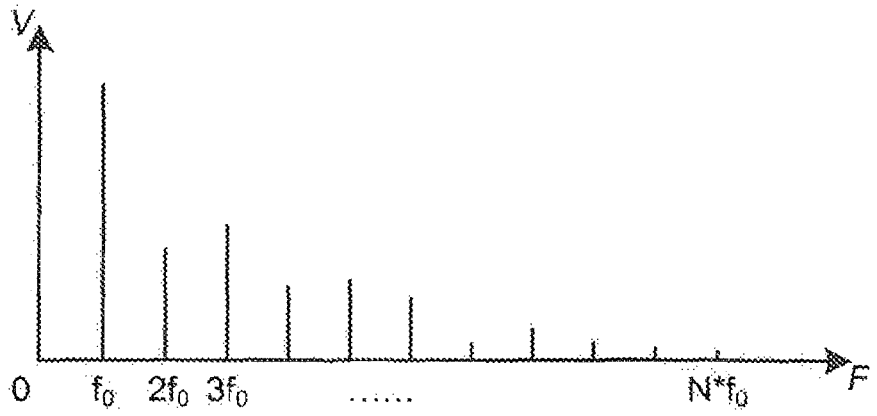
Fig. 4 Prior Art
FIG. 4 is a diagram illustrating Fourier transform of output voltage under a control of the PWM driving signal shown in FIG. 2.
Figure 5:
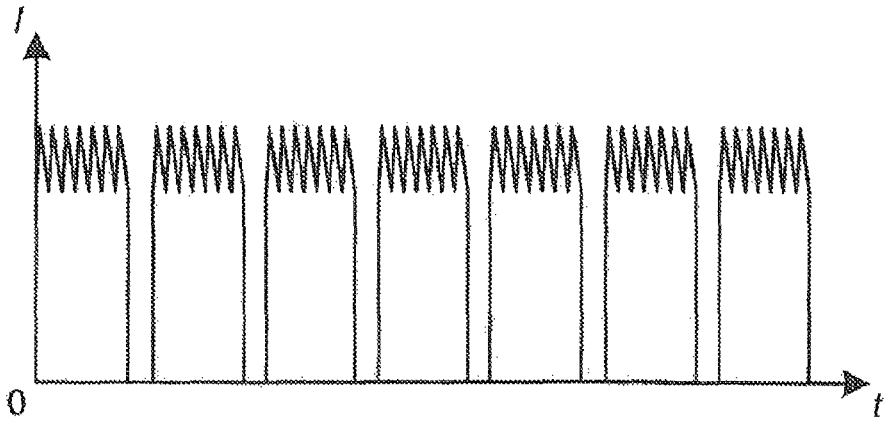
Fig. 5 Prior Art
FIG. 5 is a simulated LED driving current waveform diagram with PWM dimming according to the existing technology.
Figure 9:
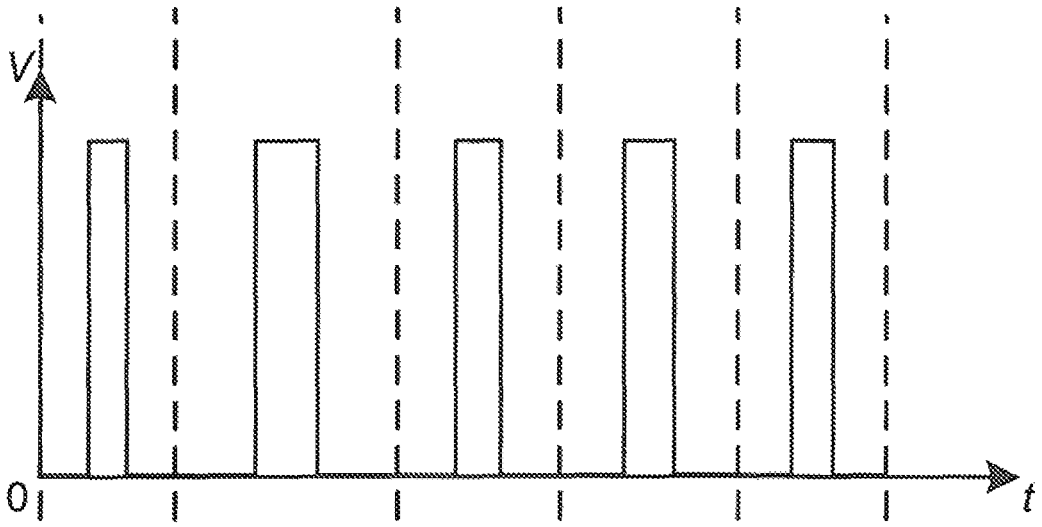
FIG. 9 is a graph illustrating relations between voltage and time of the PWM driving signal according to the example of FIG. 7.
Figure 10:
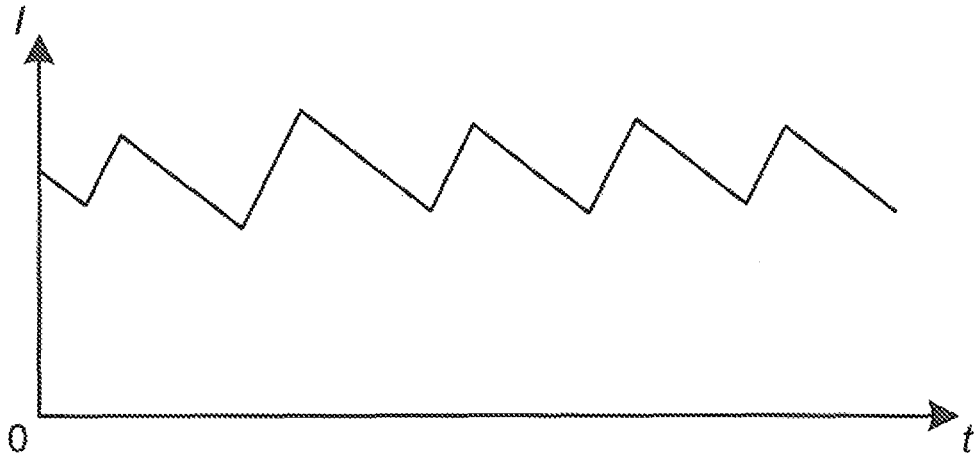
FIG. 10 is a graph illustrating the LED current waveform according to the example of FIG. 7.
Figure 11:
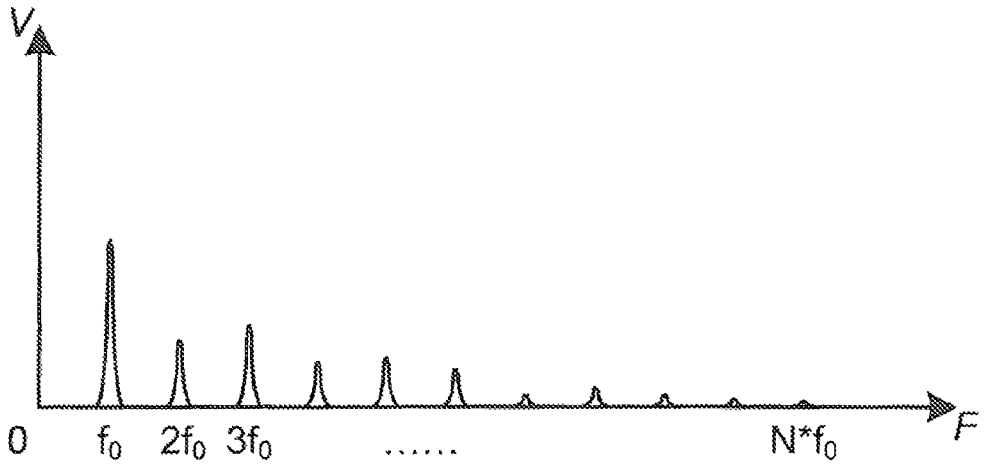
FIG. 11 is a graph illustrating the relations between voltage and frequency according to the example of FIG. 7.

If the randomized period PWM is applied to the illumination circuit (for example, the circuit shown in FIG. 1), the output voltage is shown in FIG. 9, and the LED current is shown in FIG. 10. The periods of different driving control cycles have been randomized by the MCU controller. Meanwhile, keeping a constant duty cycle can achieve the constant average current control for LED driving. In this way, the separate spectrum lines in FIG. 4 may be changed to continuous with lower amplitude, as shown in FIG. 11. This is an effective method to reduce the harmonics in high power LED driver circuits. For LED driving circuit with MCU, this could be a cost-efficient way to reduce the filter cost and the size of the driver.

Figure 12:
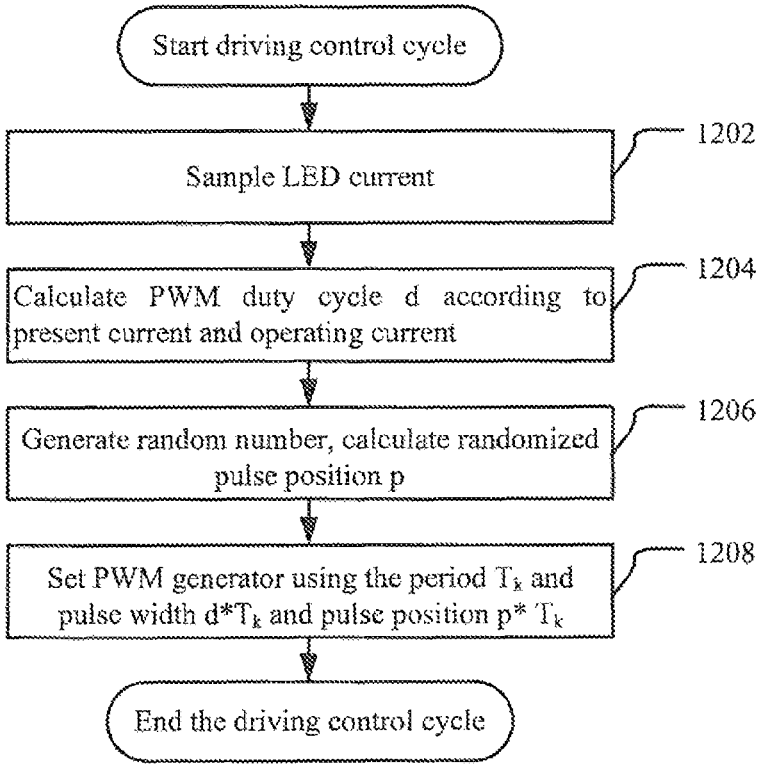
FIG. 12 is a flow chart of the method for driving the LED using randomized pulse position pulse signal according to another example.
Figure 13:
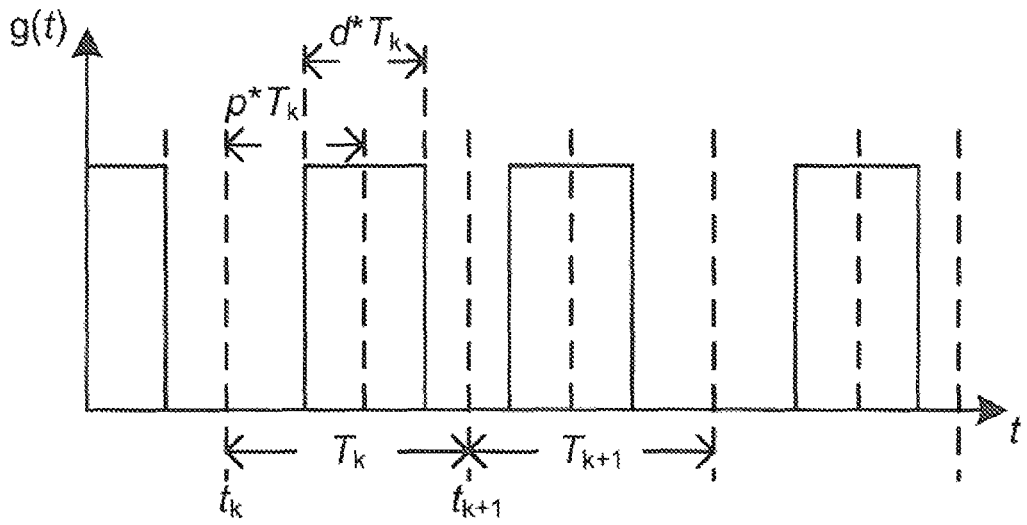
FIG. 13 is a graph illustrating relations between time and pulse signal with randomized pulse position according to the example of FIG. 12.
Figure 14:
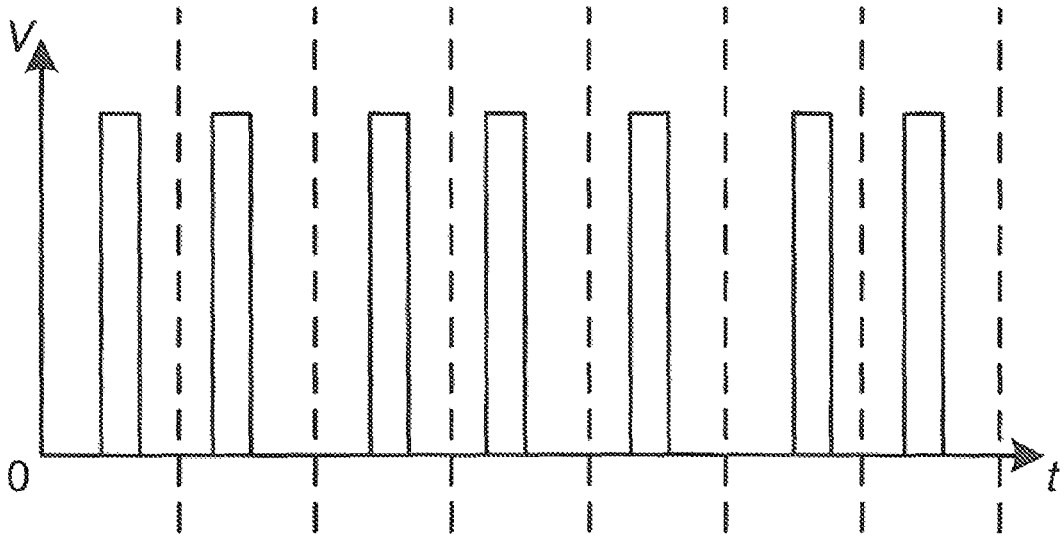
FIG. 14 is a graph illustrating relations between voltage and time of the PWM driving signal according to the example of FIG. 12.

Referring to FIG. 12, the method for driving the LED using pulse signal with randomized pulse position according to another example of FIG. 12.

As shown in FIG. 12, at first, start the driving control cycle, and then, in step 1202, sample the current of the LED to obtain a signal corresponding to the present current of the LED. In step 1204, compare the sampled signal with the pre-stored reference, then calculate the duty cycle d according to the comparison result. Wherein, the reference may be determined based on the operating current of the LED. In step 1206, generate a random number sequence, and calculate randomized pulse position sequence according to the random number sequence. In step 1208, set PWM generator according to the calculated randomized pulse position sequence and the pulse width and the period to set the pulse modulation generator to generate pulse sequence, wherein, the pulse width is a product of the duty cycle and the period. Then, the LED is driven using the pulse sequence to make the current of the LED achieve the operating current. End the drive control cycle.

Figure 15:
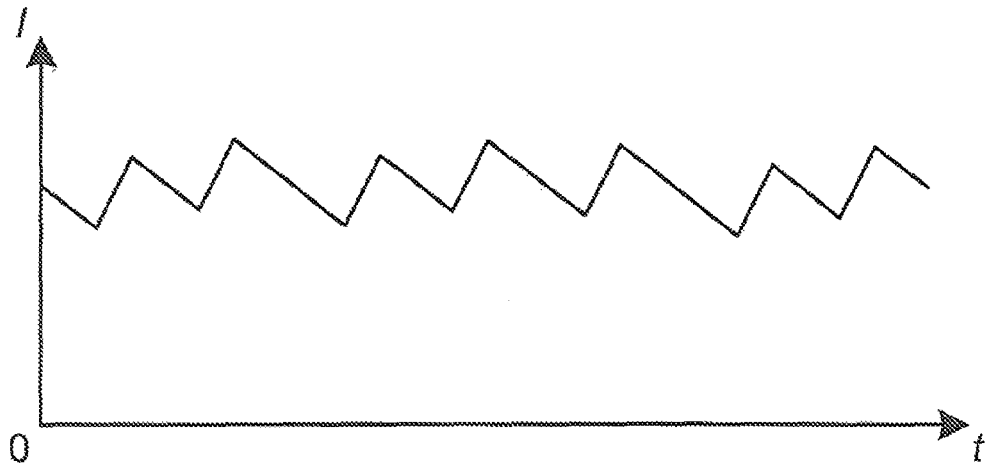
FIG. 15 is a graph illustrating the LED current waveform according to the example of FIG. 12.

Specifically, the method may be implemented by fixing the switching frequency and changing the pulse position in each control cycle. By randomizing the pulse position $p*T_k$, the power spectrum of harmonics in the circuit could be distributed. The circuit waveforms of randomized pulse position PWM are shown in FIG. 15, and the Fourier transform of the output voltage using the method is similar to that of the randomized period PWM method in FIG. 11. It is not described in detail here.

Figure 16:
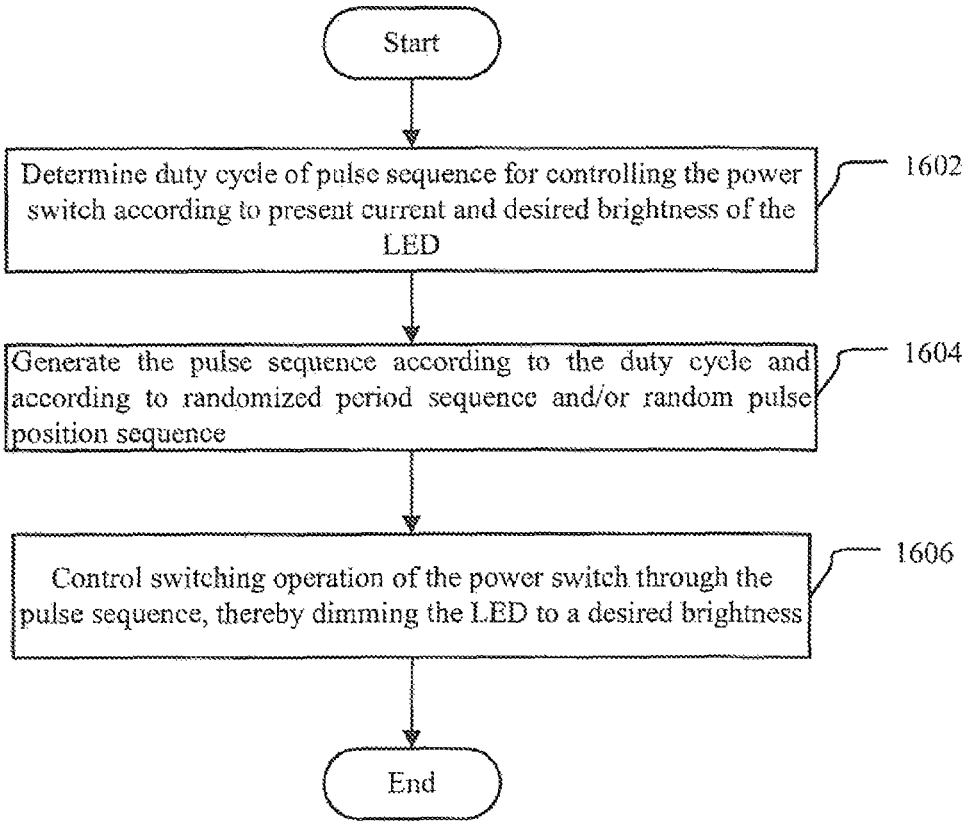
FIG. 16 is a flow chart of the method for dimming an LED according to another embodiment of the present invention.

Referring to FIG. 16, the method for dimming diode according to another embodiment of the present invention is described, wherein, the LED may be connected to power switch (for example, power semiconductor device and other appropriate power switch conventionally used in the art) through various manners.

As illustrated in FIG. 16, in step 1602, the duty cycle of pulse sequence for controlling the power switch may be determined according to present current and desired brightness of the LED. In step 1604, the pulse sequence may be generated according to the duty cycle and according to the randomized period sequence and/or randomized pulse position sequence. In step 1606, switching operation of the power switch may be controlled through pulse sequence to for dimming the LED to a desired brightness.

Specifically, in the step 604, a first random number sequence and second random number sequence may be generated; a period sequence is generated according to the first random number sequence; pulse position sequence is generated according to the second random number sequence; and pulse sequence having duty cycle and having period sequence and/or pulse position sequence is generated.

Alternatively, the randomized frequency sequence corresponding to the period sequence may be in a range of 150 Hz to 400 Hz.

Figure 17:
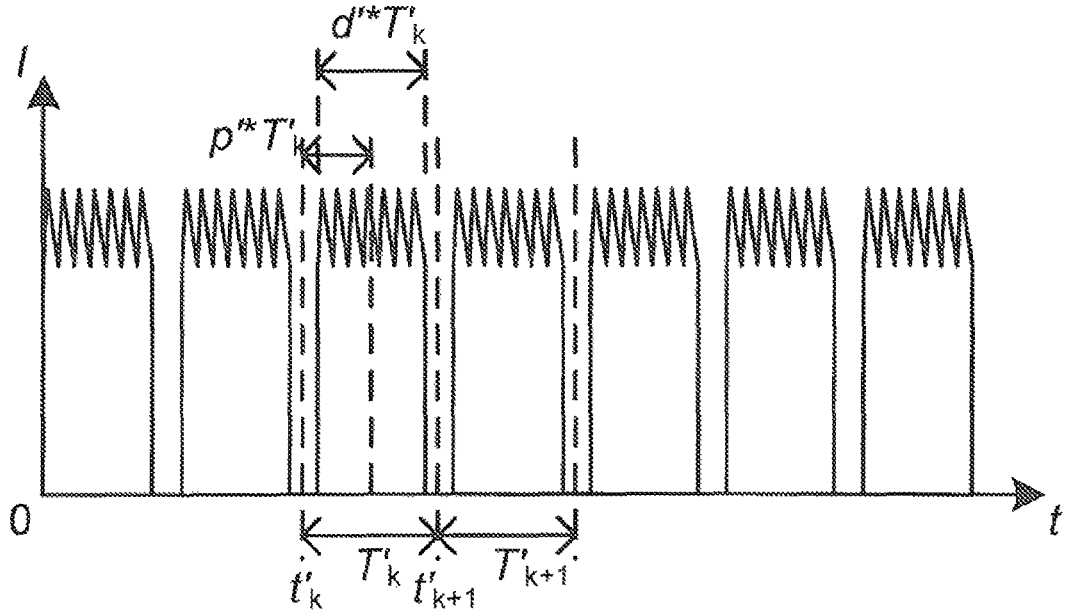
FIG. 17 is a current waveform diagram of the method for dimming the LED according to one example.

FIG. 17 is the current waveform diagram showing the method for dimming diode according to an example.

As shown in FIG. 17, the randomized PWM for dimming is similar to what have been discussed for LED driving. Variables for randomization may be the period $T_k$ and the position $p*T_k$ of the pulse centre. The risk of high EMI is often found in high frequency or radio frequency range. Since the frequency of dimming control is normally less than 1 kHz, the RPWM for dimming will not have significant impact to harmonics of the current output or the driver's EMI performances.

However, although human eyes can not detect the flickering frequency higher than 150 Hz, for some video recording cameras, the sampling frequency may interact with the dimming frequency, for example the video taken by cameras will show annoying flickering or moving bars on the image.

Randomization of the dimming PWM control could help eliminate the interaction of the sampling frequency and the dimming frequency. For a dimming cycle of the LED driving circuit, variables may include period $T'_k$, position $p'*T_k$, of the pulse centre and the pulse width $d'*T'_k$. Because the duty cycle is determined by the desired brightness and the present current and the duty cycle cannot be changed, randomization could be applied to period $T'_k$ or position of the pulse centre $p'*T'_k$ to achieve the randomized PWM for performing dimming.

Figure 18:
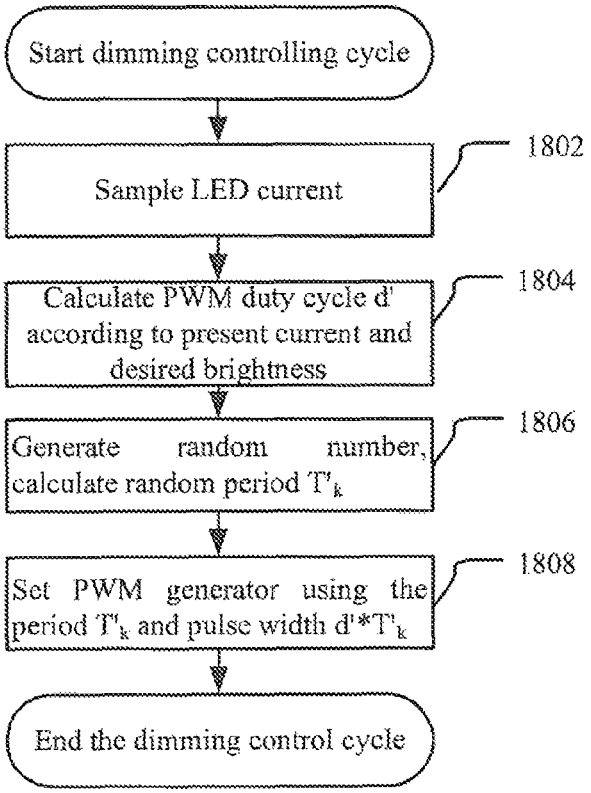
FIG. 18 is a flow chart illustrating a method for dimming diode using randomized period modulation pulse signal according to one example.

Referring to FIG. 18, the method for dimming diode using randomized period modulation pulse signal according to one example is described.

As shown in FIG. 18, at first, start the dimming control cycle, and then, in step 1802, sample the current of the LED to obtain a signal corresponding to the present current of the LED. In step 1804, compare the sampled signal with the pre-stored reference, then calculate the duty cycle d according to the comparison result. Wherein, the reference is determined based on the desired brightness of the LED. In step 1806, generate a random number sequence, and calculate randomized period sequence according to the random number sequence. In step 1808, set PWM generator according to the calculated randomized period sequence and the pulse width to set the pulse modulation generator to generate pulse sequence, wherein, the pulse width is a product of the duty cycle and the period. Then, the LED is dimmed using the pulse sequence to make the brightness of the LED achieve a desired brightness. End the dimming control cycle.

Figure 19:
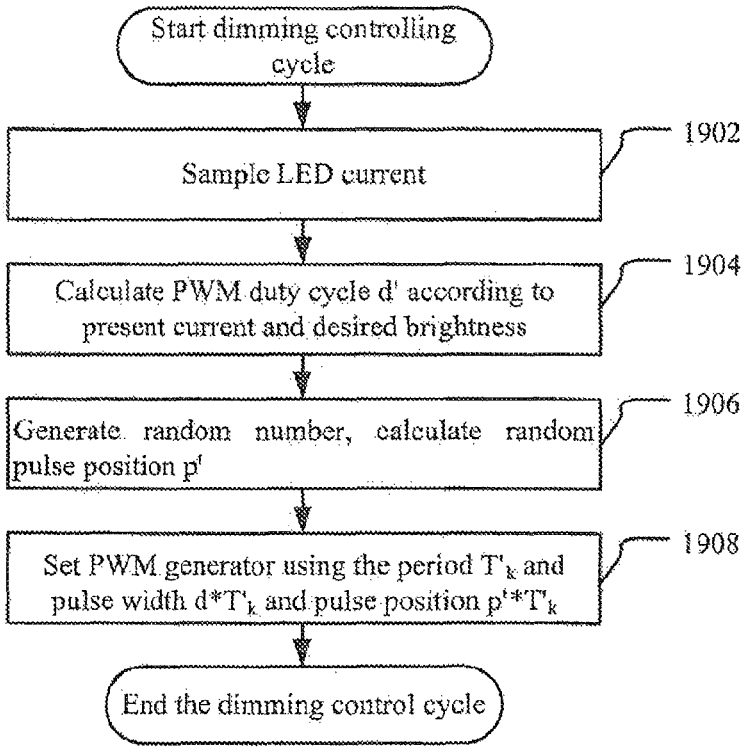
FIG. 19 is a flow chart illustrating a method for dimming diode using randomized pulse position pulse signal according to another example.

Referring to FIG. 19, the method for dimming diode using randomized pulse position pulse signal according to another example is described.

As shown in FIG. 19, at first, start the dimming control cycle, and then, in step 1902, sample the current of the LED to obtain a signal corresponding to the present current of the LED. In step 1904, compare the sampled signal with the pre-stored reference, then calculate the duty cycle d according to the comparison result. Wherein, the reference may be determined based on the desired brightness of the LED. In stop 1906, generate a random number sequence, and calculate randomized pulse position sequence according to the random number sequence. In step 1908, set PWM generator according to the calculated randomized pulse position sequence and the pulse width and the period to set the pulse modulation generator to generate pulse sequence, wherein, the pulse width is a product of the duty cycle and the period. Then, the LED is dimmed using the pulse sequence to make the brightness of the LED achieve a desired brightness. End the dimming control cycle.

Figure 20:
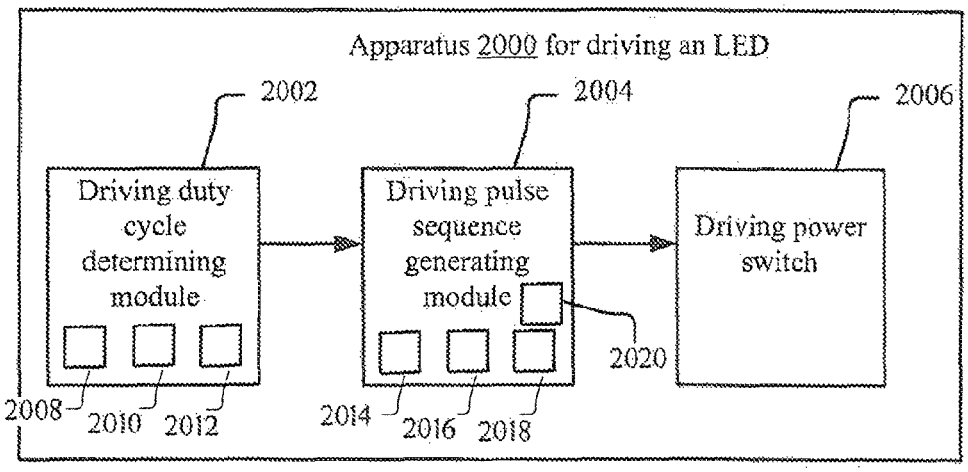
FIG. 20 is a block diagram illustrating apparatus for driving the LED according to another embodiment of the present invention.

Referring to FIG. 20, apparatus 2000 for driving an LED according to another embodiment of the present invention is described.

As shown in FIG. 20, the apparatus 2000 for driving the LED comprises: driving duty cycle determining module 2002 for determining duty cycle according to present current and predetermined operating current of the LED; driving pulse sequence generating module 2004 for generating pulse sequence according to the duty cycle and according to the randomized period sequence and/or randomized pulse position sequence; and driving power switch 2006 which is connected to the LED and is used for performing switching operation under a control of the pulse sequence, so as to drive the LED.

Wherein, the driving duty cycle determining module 2002 may comprise: driving sampling unit 2008 for sampling the present current of the LED; driving comparing unit 2010 for comparing the sampled present current and the predetermined operating current; and driving determining unit 2012 for determining duty cycle of pulse sequence for controlling the driving power switch according to the comparison result of the driving Comparing unit. If the comparison result of the driving comparing unit indicates the sampled present current is higher than the predetermined operating current, the driving determining unit determines to reduce the duty cycle; if the comparison result of the driving comparing unit indicates the sampled present current is lower than the predetermined operating current, the driving determining unit determines to increase duty cycle.

The driving pulse sequence generating module 2004 may comprise: driving random number generating unit 2014 for generating a first random number sequence and a second random number sequence; driving period generating unit 2016 for generating period sequence according to the first random number sequence; driving pulse position generating unit 2016 for generating pulse position sequence according to the second random number sequence; and driving pulse sequence generating unit 2020 for generating pulse sequence having duty cycle and having period sequence and/or pulse position sequence.

Alternatively, the randomized frequency sequence corresponding to the period sequence may be in the range of 40 kHz to 1 MHz.

Figure 21:
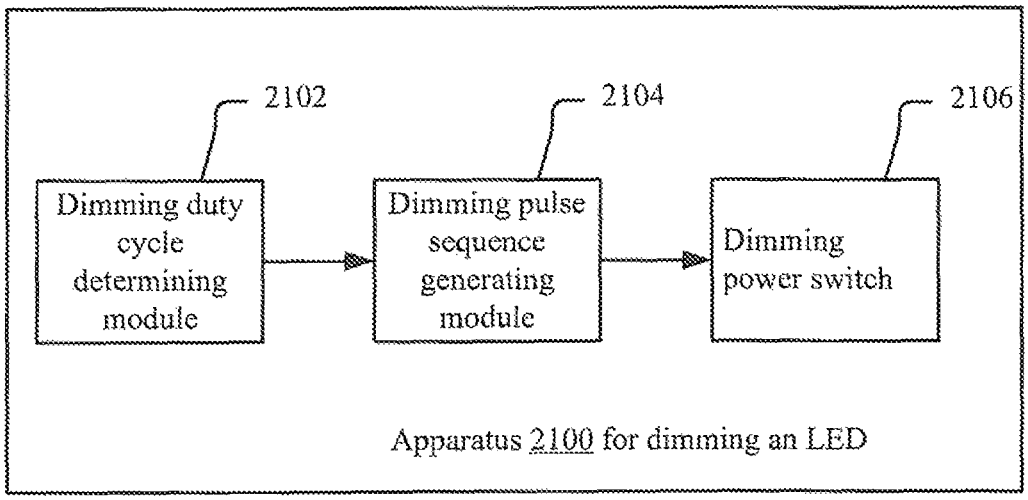
FIG. 21 is a block diagram illustrating apparatus for dimming the LED according to another embodiment of the present invention.

Referring to FIG. 21, the apparatus 2100 for dimming an LED according to further embodiment of the present invention is described.

As shown in FIG. 21, the apparatus 2100 for dimming the LED comprises: dimming duty cycle determining module 2102 for determining duty cycle according to present current and desired brightness of the LED; dimming pulse sequence generating module 2104 for generating pulse, sequence according to the duty cycle and according to the randomized period sequence and/or randomized pulse position sequence; and dimming power switch 2106 which is connected to the LED and is used for switching operation under a control of the pulse sequence, for dimming the LED to a desired brightness.

The dimming pulse sequence generating module 2104 may comprise: dimming random number generating unit for generating a first random number sequence and a second random number sequence; dimming period generating unit for generating period sequence according to the first random number sequence; dimming pulse position generating unit for generating pulse position sequence according to the second random number sequence; and dimming pulse sequence generating unit for generating pulse sequence having duty cycle and having period sequence and/or pulse position sequence.

Alternatively, the randomized frequency sequence corresponding to the period sequence may be in the range of 150 Hz to 400 Hz.

Figure 22:
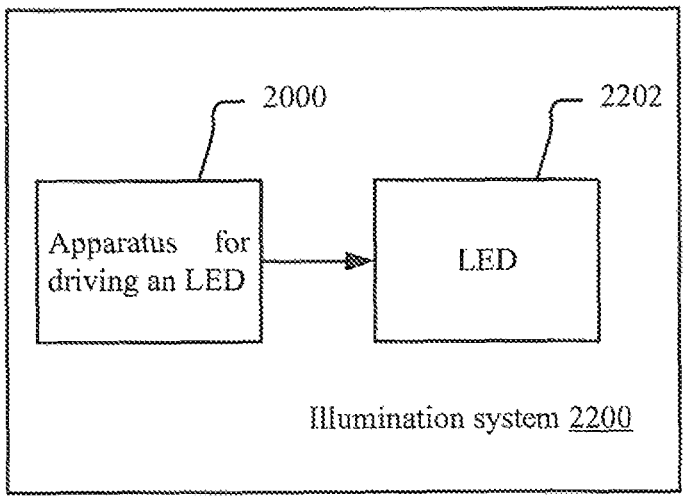
FIG. 22 is a block diagram illustrating an illumination system including the apparatus of FIG. 18.

Referring to FIG. 22, an illumination system 2200 including the apparatus of FIG. 20 is described.

As shown in FIG. 22, the illumination system 2200 may comprise LED 2202 and apparatus 2000 for driving the LED 2202.

Figure 23:
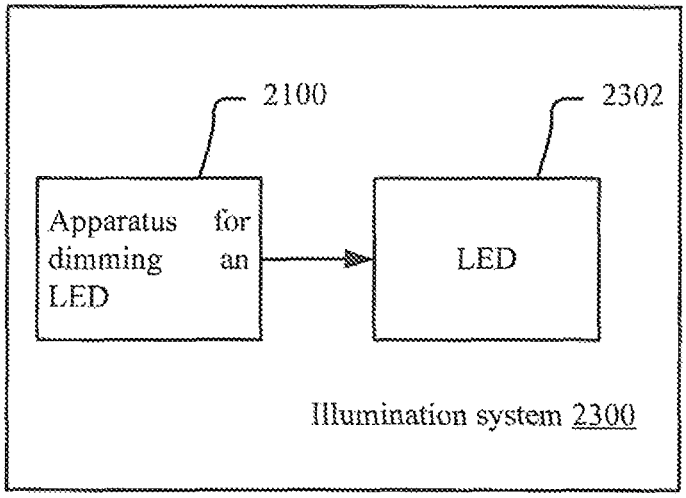
FIG. 23 is a block diagram illustrating an illumination system including the apparatus of FIG. 19.

Referring to FIG. 23, an illumination system 2300 including the apparatus of FIG. 21 is described.

As shown in FIG. 23, the illumination system 2300 may comprise LED 2302 and the apparatus 2100 for dimming the LED 2302.

Figure 24:
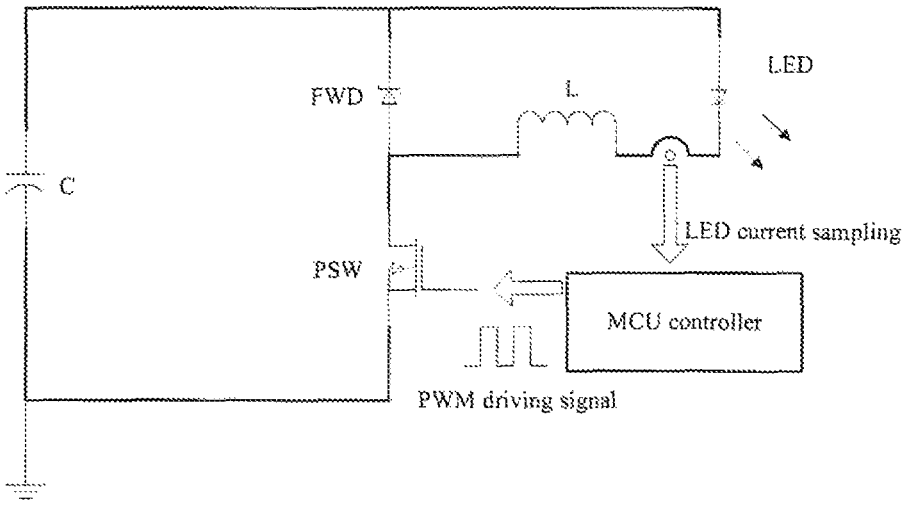
FIG. 24 is a circuit diagram of an example of the hardware and the software that may apply the embodiments according to the present invention.
Figure 25:
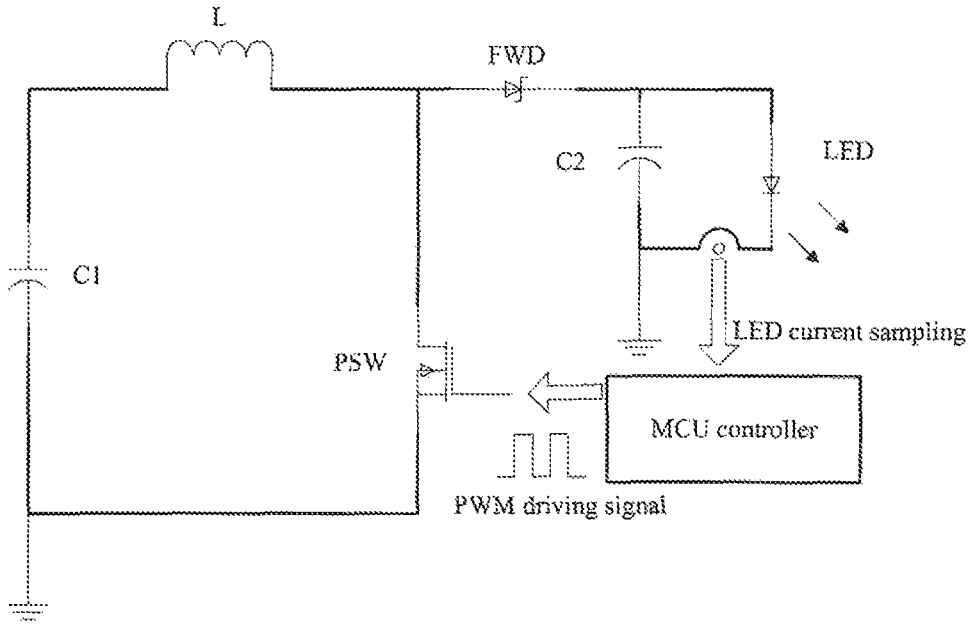
FIG. 25 is a circuit diagram of another example of the hardware and the software that may apply the embodiments according to the present invention.
Figure 26:
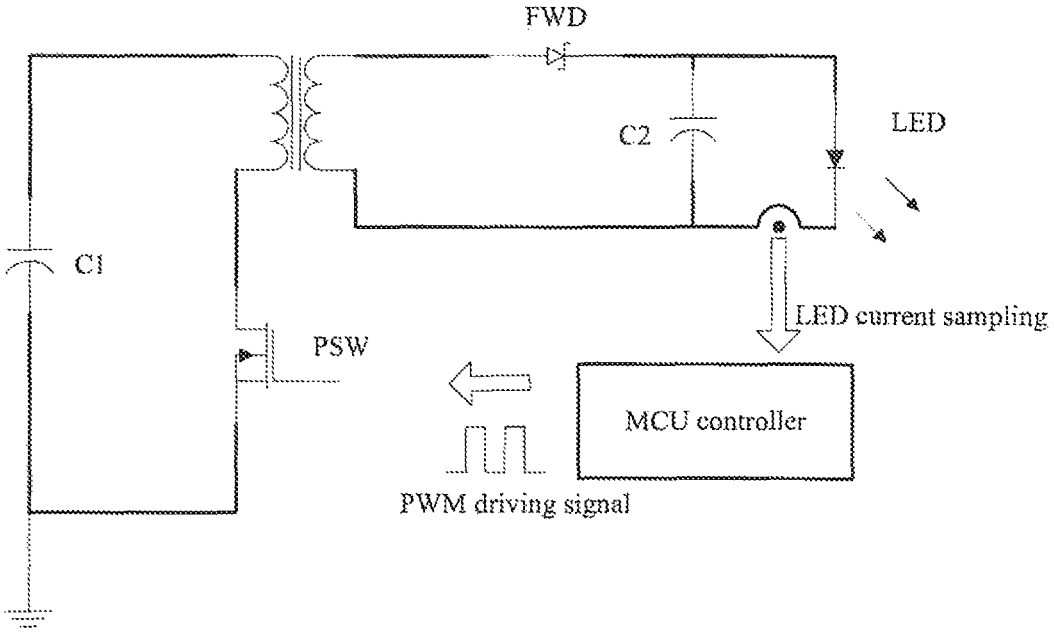
FIG. 26 is a circuit diagram of yet another example of the hardware and the software that may apply the embodiments according to the present invention.

FIGS. 24 to 26 show respectively examples that may apply hardware and software according to embodiments of the present invention. The circuit shown in FIG. 24 comprises inductor L, free wheel diode FWD, power switch PSW, capacitor C, MCU controller, and light emitting diode (may be LED series) LED. The circuit shown in FIG. 25 comprises inductor L, free wheel diode FWD, light emitting diode (or light emitting diode series) LED, power switch PSW, capacitors C1 and C2, and MCU controller. The circuit shown in FIG. 26 comprises transformer, capacitors C2 and C2, free wheel diode FWD, light emitting diode (or LED series) LED, power switch PSW, and MCU controller.

It can be seen that the RPWM method for driving and dimming LED may be applied to the circuit topologies shown in FIGS. 23 to 26. Actually, the circuit topologies to which the RPWM method for driving and dimming the LED can be applied are not limited thereto, and the RPWM method for driving and dimming the LED may be applied to other appropriate topologies. Furthermore, there may be different application for the LED illumination.

For LED driving with PWM, the switching frequency is in the range of 50 kHz to more than 1 MHz. Fixed-frequency PWM method will have high harmonics interference at the multiples of the switching frequency, while RPWM method may obtain continuous spectrum distribution of harmonics. This can help reduce the harmonies amplitude in the circuit, so as to improve the EMI performance to meet the regulations. For LED lighting electronics, this could help reduce the cost and size of filter circuit.

For LED dimming with PWM and duty cycle control, the frequency of dimming control is normally less than 1 kHz. The RPWM for dimming will not have significant impact to harmonics of the current output or the driver's EMI performance. However, although human eyes cannot detect the flickering frequency higher than 150 Hz, for some vide recording cameras, the sampling frequency may interact with the dimming frequency. For example, the video taken by cameras will show annoying flickering or moving bars on the image. Randomization of the dimming PWM control could help eliminate the effect. The randomization algorithm is similar to what have been discussed for RPWM driving.

For LED driving system with Micro-Controller, the RPWM method will add no hardware component or cost, and all the control function can be realized by software.

In the devices and method of the present invention, apparently, each component or each step may be disassembled, combined and/or recombined after being disassembled. Those disassembling and/or recombining should be regarded as equivalent solutions of the present invention. It should be further pointed out that the step performing the above series of processes may be executed naturally in time order according to the order of the Description, but not necessarily executed in time order. Some steps may be executed in parallel or independently from each other. Meanwhile, in the Description of the embodiments of the present invention, features described and/or illustrated for one embodiment may be used in one or more other embodiments in the same or similar manner, be combined with features in other embodiments or replace features in other embodiments.

It should be emphasized that the technical term "comprise/include" is used here to refer to an existence of a feature, an element, a step or a component, without excluding existences or attachments of one or more other features, elements, steps or components.

Although the device and method of the present invention have been described in detail, apparently, each component or each step may be disassembled, combined and/or recombined after being disassembled. Those disassembling and/or recombining should be regarded as equivalent solutions of the present invention. It should be further pointed out that the step performing the above series of processes may be executed naturally in time order according to the order of the Description, but not necessarily executed in time order. Some steps may be executed in parallel or independently from each other. Meanwhile, in the Description of the embodiments of the present invention, features described and/or illustrated for one embodiment may be used in one or more other embodiments in the same or similar manner, be combined with features in other embodiments or replace features in other embodiments.

It should be emphasized that the technical term "comprise/include" is used here to refer to an existence of a feature, an element, a step or a component, without excluding existences or attachments of one or more other features, elements, steps or components.

Although the present invention and its advantages have been described in detail, it should be understood that various changes, substitutions and alterations can be made herein without departing from the spirit and scope of the invention as defined by the appended claims. The scope of the present application is not intended to be limited to the particular embodiments of the processes, devices, means, methods and steps described in the specification. As one of ordinary skill in the art will readily appreciate from the disclosure of the present invention, processes, devices, means, methods, or steps, presently existing or later to be developed, that perform substantially the same function or achieve substantially the same result as the corresponding embodiments described herein may be utilized according to the present invention. Accordingly, the appended claims are intended to include within their scope such processes, devices, means, methods, or steps.

Although the present invention and its advantages have been described in detail, it should be understood that various changes, substitutions and alterations can be made herein without departing from the spirit and scope of the invention as defined by the appended claims. The scope of the present application is not intended to be limited to the particular embodiments of the processes, devices, means, methods and steps described in the specification. As one of ordinary skill in the art will readily appreciate from the disclosure of the present invention, processes, devices, means, methods, or steps, presently existing or later to be developed, that perform substantially the same function or achieve substantially the same result as the corresponding embodiments described herein may be utilized according to the present invention. Accordingly, the appended claims are intended to include within their scope such processes, devices, means, methods, or steps.

What is claimed is:

1. A method for driving a light emitting diode connected to a power switch, the method comprising: determining a duty cycle of a pulse sequence for controlling the power switch according to a present current and a predetermined operating current of the light emitting diode; generating the pulse sequence according to the duty cycle and according to at least one of a randomized period sequence and a randomized pulse position sequence; and controlling switching operation of the power switch by the pulse sequence, so as to drive the light emitting diode, wherein, the step of determining the duty cycle of the pulse sequence for controlling the power switch according to the present current and the predetermined operating current of the light emitting diode comprises: sampling the present current of the light emitting diode; comparing the sampled present current and the predetermined operating current; and calculating the duty cycle of the pulse sequence for controlling the power switch according to a comparison result.

2. The method according to claim 1, wherein the step of determining the duty cycle of the pulse sequence for controlling the power switch according to the comparison result comprises: if the comparison result indicates the sampled present current is higher than the predetermined operating current, the duty cycle is decreased.

3. The method according to claim 1, wherein the step of determining the duty cycle of the pulse sequence for controlling the power switch according to the comparison result comprises: if the comparison result indicates the sampled present current is lower than the predetermined operating current, the duty cycle is increased.

4. The method according to claim 1, wherein the step of generating the pulse sequence according to the duty cycle and according to at least one of the randomized period sequence and the randomized pulse position sequence comprises: generating a first random number sequence and a second random number sequence; generating the period sequence according to the first random number sequence; generating the pulse position sequence according to the second random number sequence: and generating the pulse sequence haying the duty cycle and having at least one of the period sequence and the pulse position sequence.

5. The method according to claim 1, wherein a randomized frequency sequence corresponding to the period sequence is within a range of 40 kHz to 1 MHz.

6. A method for dimming an light emitting diode, wherein the light emitting diode is connected to a power switch, the method comprising:

determining a duty cycle of a pulse sequence for controlling the power switch according to a present current and a desired brightness of the light emitting diode;

generating the pulse sequence according to the duty cycle and according to at least one of a randomized period sequence and a randomized pulse position sequence; and controlling switching operation of the power switch by the pulse sequence, for dimming the light emitting diode to a desired brightness, wherein, the generating the pulse sequence according to the duty cycle and according to at least one of the randomized period sequence and the randomized pulse position sequence comprises: generating a first random number sequence and a second random number sequence; generating the period sequence according to the first random number sequence; generating the pulse position sequence according to the second random number sequence; and generating the pulse sequence having the duty cycle and having at least one of the period sequence and the pulse position sequence.

7. The method according to claim 6, wherein a randomized frequency sequence corresponding to the period sequence is within a range of 150 Hz to 400 Hz.

8. An apparatus for driving a light emitting diode, comprising: a driving duty cycle determining module for determining a duty cycle according to a present current and a predetermined operating current of the light emitting diode; a driving pulse sequence generating module for generating the pulse sequence according to the duty cycle and according to at least one of a randomized period sequence and a randomized pulse position sequence; and a driving power switch which is connected to the light emitting diode and is used for switching operation under control of the: pulse sequence, so as to drive the light emitting diode, wherein the driving duty cycle determining module comprises: a driving sampling unit for sampling the present current of the light emitting diode; a driving comparing unit for comparing the sampled present current and the predetermined operating current; and a driving determining unit for determining the duty cycle of the pulse sequence for controlling the power switch according to a comparison result of the driving comparing unit.

9. The apparatus according to claim 8, wherein, if the comparison result of the driving comparing unit indicates the sampled present current is higher than the predetermined operating current, the driving determining unit determines to decrease the duty cycle.

10. The apparatus according to claim 8, wherein, if the comparison result of the driving comparing unit indicates the sampled present current is lower than the predetermined operating current, the driving determining unit determines to increase the duty cycle.

11. The apparatus according to claim 8, wherein the driving pulse sequence generating module comprises: a driving random number generating unit for generating a first random number sequence and a second random number sequence; a driving period generating unit for generating the period sequence according to the first random number sequence; a driving pulse position generating unit for generating the pulse position sequence according to the second random number sequence; and a driving pulse sequence generating unit for generating the pulse sequence having the duty cycle and having at least one of the period sequence and the pulse position sequence.

12. The apparatus according to claim 8, wherein a randomized frequency sequence corresponding to the period sequence is within a range of 40 kHz to 1 MHz.

13. An apparatus for dimming a light emitting diode, comprising: a dimming duty cycle determining module for determining a duty cycle according to a present current and a desired brightness of the light emitting diode; a dimming pulse sequence generating module for generating the pulse sequence according to the duty cycle and according to at least one of a randomized period sequence and a randomized pulse position sequence; and a dimming power switch which is connected to the light emitting diode, and is used for switching operation under control of the pulse sequence, for dimming the light emitting diode to a desired brightness, wherein the dimming pulse sequence generating module comprises: a dimming random number generating unit for generating a first random number sequence and a second random number sequence; a dimming period generating unit for generating the period sequence according to the first random number sequence; a dimming pulse position generating unit for generating the pulse position sequence according to the second random number sequence; and a dimming pulse sequence generating unit for generating the pulse sequence having the duty cycle and having at least one of the period sequence and the pulse position sequence.

14. The apparatus according to claim 13, wherein a randomized frequency sequence corresponding to the period sequence is within a range of 150 Hz to 400 Hz.

15. An illumination system, comprising: a light emitting diode; and an apparatus, comprising: a driving duty cycle determining module for determining a duty cycle according to a present current and a predetermined operating current of the light emitting diode; a driving pulse sequence generating module for generating the pulse sequence according to the duty cycle and according to at least one of a randomized period sequence and a randomized pulse position sequence; and a driving power switch which is connected to the light emitting diode and is used for switching operation under control of the: pulse sequence, so as to drive the light emitting diode; wherein the driving duty cycle determining module comprises: a driving sampling unit for sampling the present current of the light emitting diode; a driving comparing unit for comparing the sampled present current and the predetermined operating current; and a driving determining unit for determining the duty cycle of the pulse sequence for controlling the power switch according to a comparison result of the driving comparing unit.

16. An illumination system, comprising: a light emitting diode; and an apparatus, comprising: a dimming duty cycle determining module for determining a duty cycle according to a present current and a desired brightness of the light emitting diode; a dimming pulse sequence generating module for generating the pulse sequence according to the duty cycle and according to at least one of a randomized period sequence and a randomized pulse position sequence; and a dimming power switch which is connected to the light emitting diode, and is used for switching operation under control of the pulse sequence, for dimming the light emitting diode to a desired brightness, wherein the dimming pulse sequence generating module comprises: a dimming random number generating unit for generating a first random number sequence and a second random number sequence; a dimming period generating unit for generating the period sequence according to the first random number sequence; a dimming pulse position generating unit for generating the pulse position sequence according to the second random number sequence; and a dimming pulse sequence generating unit for generating the pulse sequence having the duty cycle and having at least one of the period sequence and the pulse position sequence.

* * * * *

UNITED STATES PATENT AND TRADEMARK OFFICE

CERTIFICATE OF CORRECTION

PATENT NO. : 9,119,238 B2
APPLICATION NO. : 13/820160
DATED : August 25, 2015
INVENTOR(S) : Yang Hu et al.

It is certified that error appears in the above-identified patent and that said Letters Patent is hereby corrected as shown below:

In The Specification

Column 2, line 17: Please delete “harmonies” between the words “the” and “amplitude”, and write “harmonics” in place thereof.

Column 2, line 19: Please write “;” between “M.” and “Verghese”.

Column 2, line 48: Please delete “harmonies” between the words “FIG.4,” and “occurs”, and write “harmonics” in place thereof.

Column 3, line 27: Please delete “a” between the words “to” and “the”.

Column 8, line 1: Please delete “$p'*T_k$,” between the words “position” and “of”, and write “$p'*T'_k$” in place thereof.

Column 9, line 30: Please delete “,” between the words “pulse” and “sequence”.

Column 10, line 26: Please delete the last word “vide” in the line and write “video” in place thereof.

Signed and Sealed this
Ninth Day of February, 2016

Michelle K. Lee

Michelle K. Lee
*Director of the United States Patent and Trademark Office*